United States Patent [19]

Forquer

[11] Patent Number: 4,457,106

[45] Date of Patent: Jul. 3, 1984

[54] SHUTTER SYSTEM

[75] Inventor: William F. Forquer, Venice, Fla.

[73] Assignee: Security Shutter Corp., Venice, Fla.

[21] Appl. No.: 305,929

[22] Filed: Sep. 28, 1981

[51] Int. Cl.[3] ..... E06B 11/00

[52] U.S. Cl. ..... 49/158; 49/64; 160/197

[58] Field of Search ..... 49/158–160; 160/197, 222

[56] References Cited

U.S. PATENT DOCUMENTS

| | | | |
|---|---|---|---|
| 536,423 | 3/1895 | Elwell | 49/158 |
| 1,961,327 | 6/1934 | Barth | 49/158 |
| 3,429,070 | 2/1969 | Hurst | 49/158 |
| 3,991,519 | 11/1976 | Bakke | 49/159 |

*Primary Examiner*—Kenneth Downey

*Attorney, Agent, or Firm*—Hauke and Patalidis

[57] ABSTRACT

A system for suspending at least one shutter and for elevating the shutter or shutters for use as an awning. The shutters are slidable along rails and are engageable so as to cover a predetermined width when closed.

11 Claims, 8 Drawing Figures

FIG. 1
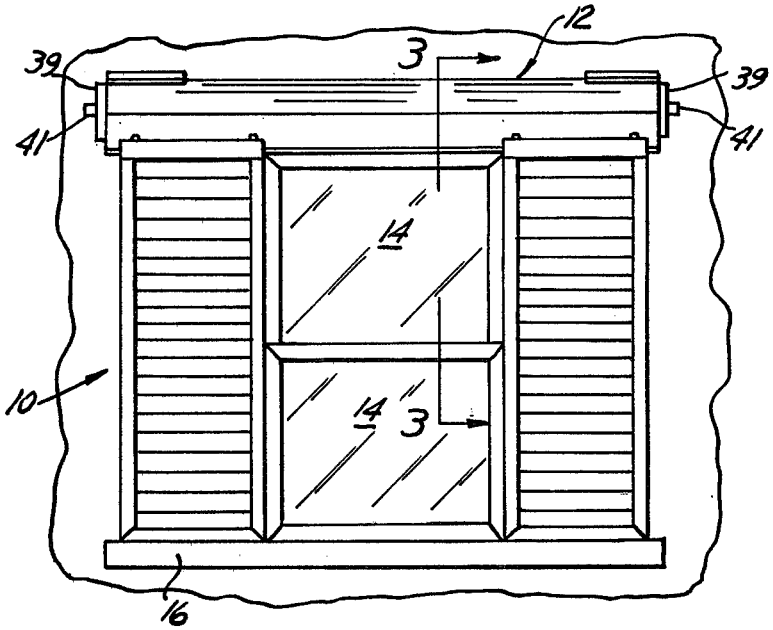
FIG. 2
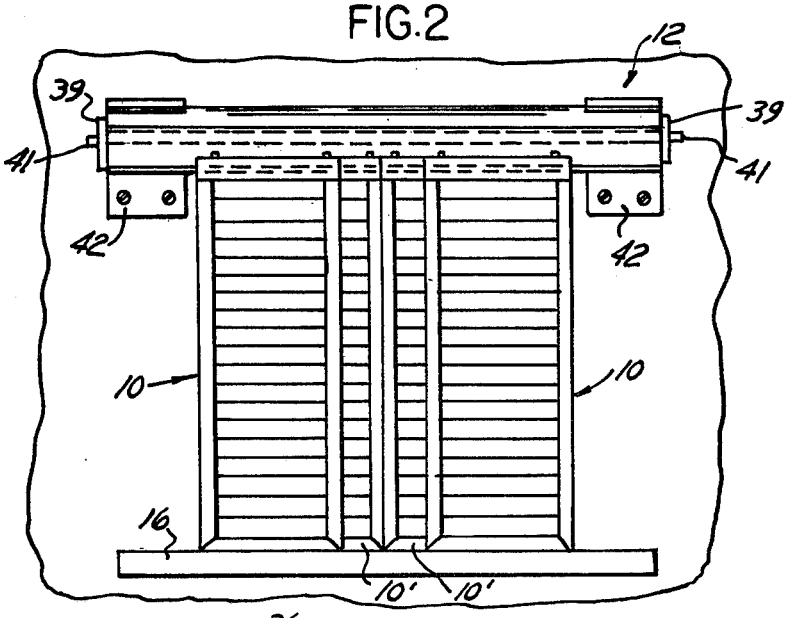
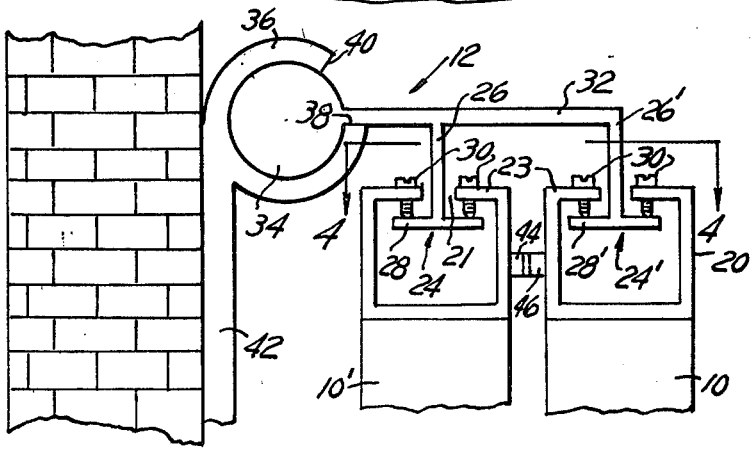
FIG. 3

FIG. 4
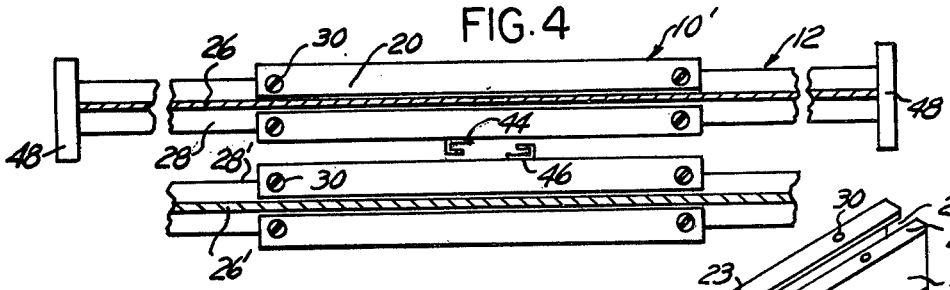
FIG. 6
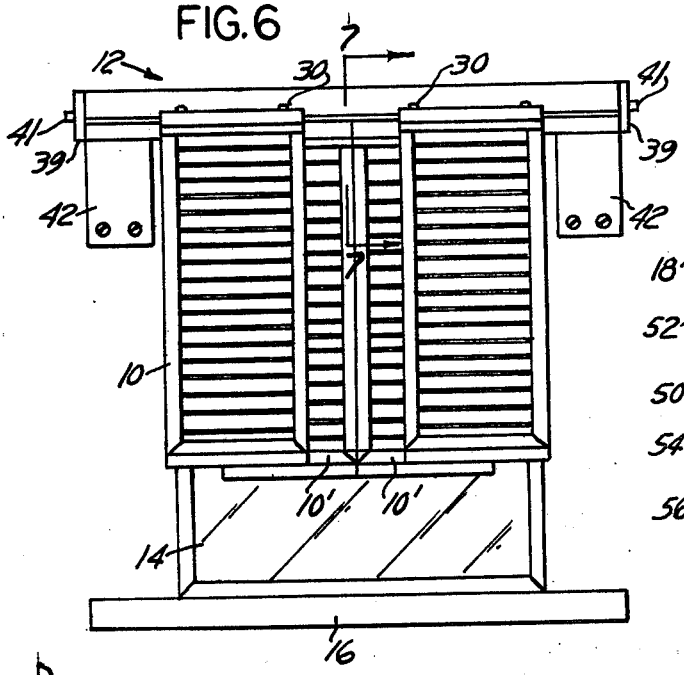
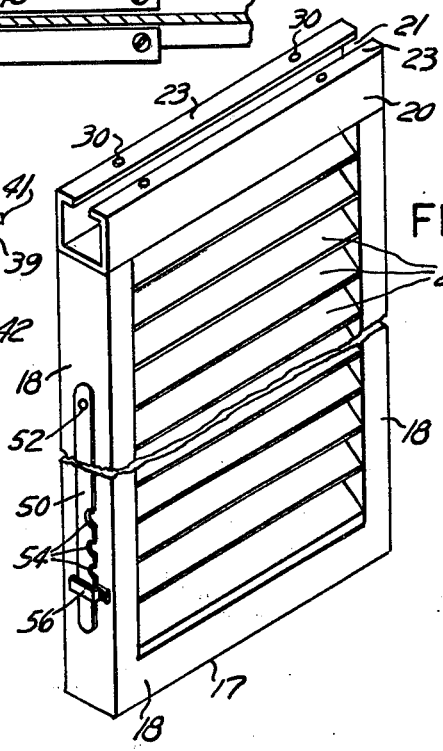
FIG. 5
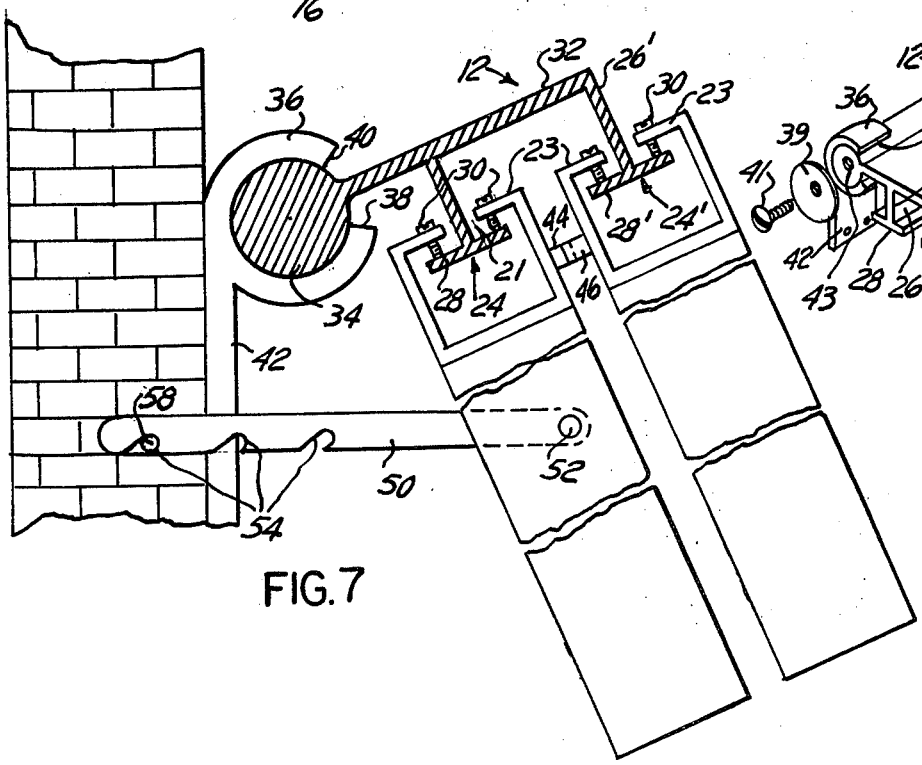
FIG. 7
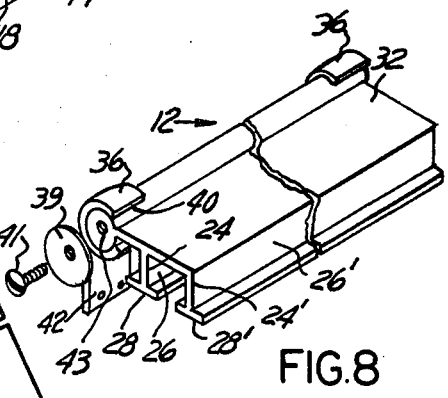
FIG. 8

SHUTTER SYSTEM

BACKGROUND OF THE INVENTION

The present invention relates to a shutter system for dwelling houses, apartments, condominiums and other buildings. The system of the invention further relates to shutter units which are highly ornamental, functional for the purpose of shading, and which can be disposed to a position suitable for using the shutter unit or units as an awning.

Shutters which are presently available are designed to be either ornamental or functional. Both of these conventional types have disadvantages.

The ornamental-type shutter is usually integrally molded in a single piece. Its purpose is decorative and therefore an ornamental shutter is fixedly mounted to the side of a window or door. Being so affixed, an ornamental shutter affords no shading from sunlight to the occupants of a building.

Functional shutters, on the other hand, are movable either in a roll-up or foldable manner. When in use, functional shutters are placed in front of an aperture such as a glass door or a window, for example, for the purpose of shading the aperture from the sun. When not in use, the shutter is removed to a position away from the aperture. Such an arrangement often has the disadvantage of blocking out all the light and air when the shutters are closed and letting in too much light or draft when the shutters are in their open position.

While it is occasionally desirable to an occupant of a building to have the total blockage of light provided by some conventional functional shutters, for example, to protect his privacy, there are other times when mere partial shading from the direct rays of the sun is all that is desired.

To overcome this disadvantage of functional shutters, a building owner may elect to install awnings. However, awnings, being generally made of canopies suspended above a window or a door, often lack aesthetic appeal. Awnings also do not protect the privacy of the occupants of a building by obstructing the view into the building as shutters do.

Installation of both ownings and shutters would present inconveniences to a building owner, such as excessive expenditure. What is needed, therefore, is a system which increases the versatility of functional shutters by incorporating an awning function.

SUMMARY OF THE INVENTION

The present invention is an improvement on functional shutters. The shutter unit of the present invention can be placed in front of a window or door when in use and slid to the sides of the window or door when not in use. Further, the shutters are suspended from rail members that allow the shutters to be pivoted, if so desired, such as to be angularly disposed to form an awning.

The present invention also provides for the positioning of a plurality of shutter units along rail members by manually sliding one shutter unit only. The other shutter units are placed in position as a result of engagement between abutment members affixed to each of the shutter units. The abutment members can be placed on the shutter units during installation of the shutter system so that the sliding of one shutter unit will cause the plurality of shutter units to cover a predetermined area, such as a window or door.

The many objects and advantages of the present invention will be apparent to those skilled in the art when the following description of the best mode contemplated for practicing the invention is read in conjunction with the drawing wherein like reference numerals refer to like and equivalent elements, and in which:

BRIEF DESCRIPTION OF THE DRAWING

FIG. 1 is a front elevational view of an example of shutters according to the present invention as installed for the purpose of obturating a window, for example, and shown in their open position;

FIG. 2 is a view similar to FIG. 1 but showing the shutters in a closed position in front of the window;

FIG. 3 is a partial side elevational view through line 3—3 of FIG. 1;

FIG. 4 is a partial top plan view thereof from line 4—4 of FIG. 3;

FIG. 5 is a perspective view of a shutter unit;

FIG. 6 is a view similar to FIG. 2 but showing the shutter assembly disposed at an angle such as to form an awning assembly;

FIG. 7 is an elevational view, partly in section from line 7—7 of FIG. 6; and FIG. 8 is a partial perspective view of an overhead shutter suspension assembly.

DETAILED DESCRIPTION OF THE PREFERRED EMBODIMENT

Referring now to the drawing and more particularly to FIGS. 1 and 2, there are shown two sets of shutter units 10,10' suspended from an overhead suspension assembly 12 according to the present invention. The shutters 10,10' are shown in open position in FIG. 1 and in closed position in FIG. 2. When open, only the forward or outer shutter units 10 are visible, FIG. 1. On the other hand, when the inner shutter units 10' have been closed, FIG. 2, the outer shutter units are drawn together a predetermined distance according to the present invention, and the window 14 is hidden from view. For purposes of illustration, the two sets of shutter units 10,10' are shown as fitted in front of a window 14 having the usual ledge 16. The present invention is also suitable for use in front of a glass door (not shown).

The shutter units 10,10' can be made of any suitable material such as aluminum or plastic, for example, as long as the material can be formed according to the present invention. Although the overhead suspension assembly 12 can also be made of plastic, it is preferable that the overhead suspension assembly 12 be made of metal at least as strong as aluminum so that the weight of the shutter units 10,10', when suspended from the suspension assembly 12, will not cause it to bend or collapse.

At FIG. 5 there is shown a more detailed view of a shutter unit 10 according to the present invention. In the example illustrated, at least three sides of the shutter unit 10 are in the form of a frame 17 made of appropriate U-shaped channels 18. These channels 18 can be fitted together by means of clips or screws, or by welding, with a variety of joints as is well known in the art. A tubular channel 20 is attached to the top of the frame 17 for the purpose of mounting the shutter unit 10 on the suspension assembly 12 of the present invention. In the illustrated structure, the tubular channel 20 is substantially rectangular or square in section and is provided with a longitudinal slot 21 in its top surface.

The shutter unit 10 of the present invention may be provided with a plurality of louvers 22 as shown herein.

Alternatively, slats may be used. The louvers 22 or slots may be functional or fixed in an open or closed position.

The longitudinal slot 21 in the top surface of the tubular channel 20 separates two L-shaped rims 23 formed in the top of the tubular channel 20. With the slot 21 formed between the L-shaped rims 23, the shutter unit is suitable for mounting on an overhead suspension assembly 12 according to the present invention. As best shown at FIGS. 3 and 8, the slot of the shutter unit 10 is provided in the tubular channel 20 for the purpose of allowing the shutter unit 10 to be suspended from an overhead suspension assembly 12 as more fully described hereinafter.

In the example shown at the drawings and shown best at FIGS. 3 and 8, the overhead suspension assembly is provided with two inverted T-shaped rails 24,24', each having a vertical member 26,26' and a horizontal member 28,28'. The slots 21 in the tubular channels 20 permit the respective vertical members 26,26' of the T-shaped rails to be passed through the tubular channels 20 of the shutter units 10,10' when the shutter units 10,10' are slid along the T-shaped rails 24,24' into the closed position shown at FIG. 2. The horizontal members 28,28' of each T-shaped rail 24,24' provide a plane upon which the rims 23 of the tubular channels 20 can be directly placed, if desired, for the purposes of supporting the suspended shutter units 10.

However, in the example of the structure illustrated by the drawings, there is disposed through a bore in each rim 23 of the tubular channels 20 a screw 30 for the purpose of applying tension between the rims 23 and the horizontal member 28,28' of each T-shaped rail 24,24'. The screws 30 can be set at tension sufficient to allow the sliding of the shutter units 10,10' along the horizontal members 28,28' without allowing the shutter units 10, 10' to be so loosely affixed as to wobble.

It will be appreciated that the screws 30 can be replaced with a bolt, pin, clip or other appropriate means. The screws 30 could be modified, if desired, by providing a pad at their bottoms to facilitate the sliding of the shutter units 10,10' along the T-shaped rails 24,24' by reducing the friction created between the bottom of the screws 30,30' and the horizontal members 28,28'.

In the illustrated structure, the T-shaped rails 24,24' of the overhead shutter suspension assembly 12 are affixed vertically to the underside of a suspension rail or beam 32. As best shown at FIG. 8, the suspension beam 32 is substantially flat and rectangular in section.

The suspension beam 32 of the overhead suspension assemby 12 is formed integrally and radially with a cylindrical portion 34 in the example of the structure shown. The cylindrical portion 34 of the horizontal beam 32 is fitted within a cylindrical socket 36 suitable for pivoting the suspension beam 32 within the socket 36.

The cylindrical socket 36 is comprised of a lower arc 38 and an upper arc 40 each having flat end surfaces. When the suspension beam 32 is in the position shown at FIG. 3, as opposed to being pivoted diagonally as in FIG. 7, the suspension beam 32 rests on the flat end surface of the lower arc 38 of the crescent-shaped socket 40. But when raised as an awning, as shown in FIG. 7, the suspension beam 32 is disposed between the flat end surfaces of the arcs 38,40 of the socket 36 as more fully described hereafter.

It will be appreciated that the circular portion 34 of the suspension beam 32 cannot escape from the socket 36. This is so because the diameter of the circular portion 34 exceeds in width the gap between the lower arc 38 and the upper arc 40 of the socket 36. Furthermore, as best shown at FIG. 8, the circular portion 34 can be prevented from slipping laterally out of the socket 36 by means of a washer 39, for example, fitted against the flat outer surface of the socket 36 and being he31d in position by a bolt 41 or a screw. The bolt 41 is fitted through the washer 39 and into a threaded hole 43 drilled in the circular portion 34 for this purpose. It will be appreciated by those skilled in the art that several other configurations could be used to prevent slippage of the circular portion 34 from the socket 36 such as providing the socket 36 and the circular portion 34 with locking rims.

The cylindrical socket 36 is formed at one end of a support member or bracket 42. The bracket 42 is of a length sufficient to support the suspension assembly 12 when the bracket 42 or brackets are attached to a wall, for example. As shown at FIGS. 1–3, and 6–8, the overhead suspension assembly 12 is supported by two brackets 42, at each end of the assembly.

At FIG. 4 is illustrated a modification of the shutter units 10,10' wherein two abutment surfaces 44,46, preferably fixed in position along the respective tubular channels 20 by screws or other means (not shown) are provided on each of the shutter units 10,10'. These abutment surfaces 44,46, being in the form of angled brackets for the purpose of illustration, can be positioned during the installation of the shutter system so that where one of the shutter units, the inner shutter unit 10' for example, is drawn together as shown at FIG. 2, the other shutter unit 10 is also placed in position by the interlocking of the abutment surfaces 44,46. It will be appreciated that the proper placing of the these abutment surfaces 44,46 will depend upon the proper measurements of the aperture to be covered by the shutter unit 10,10', for example a window 14, and the placing of each abutment surface 44,46, on a shutter unit 10,10' so that the distance between the edges of the shutter units 10,10' and the abutment surfaces 44,46 is such that the total of such a length equals the width of the aperture to be covered.

FIG. 4 further illustrates that the end of the horizontal member 28,28' of each T-shaped rail 26,26' can be affixed with a perpendicular member 48 for the purpose of preventing the shutter unit 10,10' from sliding off of the end of the T-shaped rail 26,26'.

Referring again to FIG. 5 there is shown affixed to one outer surface of the shutter unit 10 a support arm 50. This arm 50, in the example given, is provided with a pivot point 52 at its one end and with a plurality of U-shaped slots 54 at its other end. When not in use, the support arm 50 can be held in position by a wire clamp 56, for example.

Referring now to FIGS. 6 and 7, the application of the support arm 50 is illustrated. In FIG. 6 the shutter units 10,10' have been drawn together and elevated by the use of the support arm 50. A portion of the window 14, which cannot be seen with the shutter units 10,10' in their lowered position, is illustrated as exposed when the shutter units 10,10' are elevated. With the shutters so disposed, it will be appreciated that they have the effect of an awning, i.e., a certain amount of light is allowed to enter in the exposed area between the ledge 16 and the bottom of the shutter units 10,10'.

Where the present invention is used as an awning, it may be desirable to cut the overhead suspension assembly 12 near its center so as to avoid excessive twist and strain on the overhead suspension assembly 12. If this is done, it is preferable to incorporate two additional support brackets 42 at the respective cut ends.

At FIG. 7 the operation of the overhead suspension assembly with the shutter units 10,10' raised for use as an awning is further illustrated. The support bar 50 is fitted by its slots 54 over a ridge 58 in the wall, suitable for this purpose. This ridge 58 can be a piece of rod, a nail or a bolt, for example.

When the support arm 50 is placed in position over the ridge 58, the overhead suspension assembly 12 is raised diagonally by the action of the circular portion 34, formed integrally and radially with the horizontal beam 32, being pivoted within the socket 36. The shutter units 10,10' are rigidly supported by the tension created by the set screws 30 being affixed between the rims 23 of the tubular channels 20 and the horizontal members 28,28' of the T-shaped rails 24,24'. In addition, depending upon the type of abutment surfaces 44,46 which are employed, added rigidity is achievd by way of the abutment surfaces 44 and 46 being such that they lay against each other or interlock.

It will be appreciated by those skilled in the art that the overhead suspension assembly 12 can be extruded of any appropriate material, such as an aluminum. As a further alternative, it could be formed by way of welding together any of the individual parts.

Having described the present invention by way of a practical example, modifications of which will be apparent to those skilled in the art, what is claimed as new is as follows:

1. A shutter system for covering an opening in a wall such as a window or door, said shutter system comprising at least a pair of separate shutter units, an overhead suspension rail member having a pair of substantially parallel tracks for slidably supporting each of said shutter units from each of said tracks, means attached along a top edge of each of said shutter units in engagement with one of said tracks for independently slidably supporting each of said shutter units from one of said tracks, and abutment means proximate a vertical edge of each of said shutter units for mutual engagement causing displacement of one of said shutter units by manually displacing the other of said shutter units when said one of said shutter units is displaced from a position uncovering said wall opening to a position covering said wall opening with opposite edges of each of said shutter units overlapping each other.

2. The shutter system of claim 1 wherein each of said shutter units is supported from said suspension rail by means of a tubular channel disposed along the top edge of each of said shutter units, said tubular channel having a longitudinal slot in an upper wall, and said suspension rail having a pair of parallel generally T-shaped beam members defining each one of said tracks, each of said T-shaped beam members being engaged in said tubular channel through said slot.

3. The shutter system of claim 2 wherein said tubular channel is rectangular in section.

4. The shutter system of claim 1 wherein said suspension rail member is pivotably connected to a stationary support member.

5. The shutter system of claim 4 further comprising a length-adjustable support bar member attached at an end to an edge of one of said shutter units and at the other end to said wall for holding said shutter unit in an angled awning position relative to said opening in said wall.

6. The shutter system of claim 4 wherein said pivotable connection comprises a cylindrical portion formed on one edge of said suspension rail and a slotted cylindrical socket in said stationary support member in which said cylindrical portion is pivotably disposed, each edge of the slot in said cylindrical socket forming abutment surfaces limiting pivotal motion of said suspension rail relative to said slotted cylindrical socket.

7. The shutter system of claim 6 further comprising a length-adjustable support bar member attached at an end to an edge of one of said shutter units and at the other end to said wall for holding said shutter unit in an angled awning position relative to said opening in said wall.

8. The shutter system of claim 1 wherein each of said shutter units is provided with a plurality of louvers disposed along an outer surface.

9. The shutter system of claim 1 wherein said suspension rail member is made of aluminum.

10. The shutter system of claim 1 wherein each of said shutter units is made of aluminum.

11. The shutter system of claim 1 wherein each of said shutter units is made of plastic.

* * * * *

UNITED STATES PATENT AND TRADEMARK OFFICE

CERTIFICATE OF CORRECTION

PATENT NO. : 4,457,106

DATED : July 3, 1984

INVENTOR(S) : William F. Forquer

It is certified that error appears in the above-identified patent and that said Letters Patent are hereby corrected as shown below:

Column 4, line 6 "he3ld" should read --held--;

Column 5, line 19 "achievd" should read --achieved--.

Signed and Sealed this

*Twenty-second* Day of *January 1985*

[SEAL]

*Attest:*

DONALD J. QUIGG

*Attesting Officer* *Acting Commissioner of Patents and Trademarks*